US008833623B2

(12) United States Patent
Scicluna

(10) Patent No.: US 8,833,623 B2
(45) Date of Patent: Sep. 16, 2014

(54) BAG WITH SELF-ADJUSTING STRAPS

(75) Inventor: Paul Scicluna, Penndel, PA (US)

(73) Assignee: Tumi, Inc., South Plainfield, NJ (US)

( * ) Notice: Subject to any disclaimer, the term of this patent is extended or adjusted under 35 U.S.C. 154(b) by 22 days.

(21) Appl. No.: 12/868,299

(22) Filed: Aug. 25, 2010

(65) Prior Publication Data

US 2012/0048904 A1 Mar. 1, 2012

(51) Int. Cl.
*A45F 3/04* (2006.01)

(52) U.S. Cl.
USPC ..... 224/607; 224/608

(58) Field of Classification Search
USPC ..... 224/627, 631, 639, 637, 578–580, 600, 224/607, 608, 645
See application file for complete search history.

(56) References Cited

U.S. PATENT DOCUMENTS

| | | | | |
|---|---|---|---|---|
| 3,957,184 | A * | 5/1976 | Shurman | 224/630 |
| 5,411,194 | A * | 5/1995 | Nagasawa et al. | 224/254 |
| 5,586,705 | A * | 12/1996 | Leonard | 224/631 |
| 6,375,053 | B1 * | 4/2002 | Cecchinel | 224/267 |
| 2006/0163305 | A1 * | 7/2006 | Tong | 224/628 |

FOREIGN PATENT DOCUMENTS

| | | | |
|---|---|---|---|
| CH | 227720 | | 6/1943 |
| CH | 227720 | A | 6/1943 |
| CN | 2662719 | Y | 12/2004 |
| DE | 29910127 | | 9/1999 |
| DE | 202009009039 | | 9/2009 |
| GB | 1033130 | | 6/1966 |
| WO | 9426143 | A1 | 11/1994 |

OTHER PUBLICATIONS

European Search Report for EP 11174591, dated Oct. 26, 2011.

* cited by examiner

*Primary Examiner* — Adam Waggenspack
(74) *Attorney, Agent, or Firm* — Jon Fallon, Esq.; Michael P. Kochka, Esq.

(57) ABSTRACT

A bag, such as a backpack, having self-adjusting straps comprising a stretchable elastomeric strip and a reinforcing webbing strip. The self adjusting straps are coupled to the back panel only at the bottom of the panel such that the top portion of the straps, which engages a user's shoulders, is free from a fixed attachment to the back panel. Accordingly, the straps of the bag are configured to adjust according to the weight of the cargo placed within the bag, as well as to the size of the user, automatically and without the need for manual loosening or lengthening of a the shoulder strap.

17 Claims, 5 Drawing Sheets

BAG WITH SELF-ADJUSTING STRAPS

BACKGROUND OF THE DISCLOSED SUBJECT MATTER

1. Field of the Disclosed Subject Matter

The disclosed subject matter relates to a bag with self-adjusting straps. Particularly, the present disclosed subject matter is directed to bags having self-adjusting straps, such as a backpack, which can extend or contract in response to the weight of the bag and size or shape of the user to better distribute the load and provide a more ergonomic fit for the user.

2. Description of Related Art

A variety of types of backpacks are known in the art. Conventional backpack designs distribute the load onto the shoulders of the user in a manner which is determined by the length of the shoulder straps. While such designs provide a distribution which is suitable for a given load, when the load is increased the predetermined weight distribution may not be suitable to the user, thereby requiring manual adjustment of the shoulder straps. Additionally, conventional shoulder strap designs fail to effectively accommodate users in dynamic situations such as walking, climbing, and related activities, wherein the relative spatial orientation of the various parts of the user's body changes with movement. As a result, the load is disproportionately placed on one shoulder or the other often leading to fatigued muscles.

A further disadvantage of backpacks known in the art is that the physical distances between the hip and shoulder supports are fixed during use. As a result, raising of the shoulders, for example, causes disproportionate placement of the load onto the shoulders and additionally bending by the user is severely restricted.

Furthermore, adjustment of the shoulder straps in conventional bag designs requires manual adjustment to the shoulder straps, as well as complex buckle/clasp configurations for retaining the fixed strap length. These buckles and clasps often interfere with the user's movement during usage and require advanced dexterity to operate.

Although such conventional methods and systems generally have been considered satisfactory for their intended purpose, there remains a need for self-adjusting load support straps which overcome the above-described limitations and provide a desired dynamic load distribution.

SUMMARY OF THE DISCLOSED SUBJECT MATTER

The purpose and advantages of the disclosed subject matter will be set forth in and apparent from the description that follows, as well as will be learned by practice of the disclosed subject matter. Additional advantages of the disclosed subject matter will be realized and attained by the methods and systems particularly pointed out in the written description and claims hereof, as well as from the appended drawings.

To achieve these and other advantages and in accordance with the purpose of the disclosed subject matter, as embodied and broadly described, the disclosed subject matter includes a bag with self-adjusting straps which can extend and retract automatically. In an exemplary embodiment, a bag having an exterior and interior configured to receive cargo, comprises at least one panel having a top and bottom portion, and at least one strap having a first end and a second end. The at least one strap includes an elastomeric strip having a first end and a second end, wherein the distance between the first end and second end is variable. The first and second ends of the strap are coupled to the bottom portion of the at least one panel.

The at least one strap can include a webbing strip coupled to the elastomeric strip, with the webbing strip having a substantially fixed length which limits the elongation of the elastomeric strip. Furthermore, the at least one panel includes first and second sides defining a width of the bag having a midpoint therebetween, wherein the first and second ends of the strap are coupled to the at least one panel at the midpoint thereof.

The at least one strap can be stitched to the at least one panel. Additionally, the first and second ends of the at least one strap are coupled to the at least one panel at the same location on the at least one panel. The at least one strap can be configured as two distinct members. Additionally, or alternatively, the at least one strap is configured as a generally Y-shaped member. A first elastomeric strip is oriented substantially vertical with respect to the at least one panel, and a second elastomeric strip is oriented substantially perpendicular to the first elastomeric strip. In some embodiments, the second elastomeric strip is readily accessible and coupled to an exterior surface of the panel, and the first elastomeric strip is coupled to an interior surface of the panel.

In accordance with another aspect of the disclosed subject matter, a bag having self-adjusting straps comprises at least one panel, and at least one self-adjusting strap. The at least one self-adjusting strap includes an elastomeric strip, the elastomeric strip having a first end and a second end, wherein the distance between the first end and second end is variable; and a webbing strip having a substantially fixed length. The strap is coupled, e.g., stitched, to the at least one panel at a single position on the at least one panel.

The at least one self-adjusting strap is configured as two distinct members, or as a generally Y-shaped member. A first elastomeric strip is oriented substantially perpendicular to a second elastomeric strip, and the second elastomeric strip is readily accessible and coupled to an exterior surface of the panel. The first elastomeric strip is coupled to an interior surface of the panel, and is configured for greater displacement than the second elastomeric strip. The elastomeric strip is stitched to the webbing strip. Further, the bag is configured as a backpack.

It is to be understood that both the foregoing general description and the following detailed description are exemplary and are intended to provide further explanation of the disclosed subject matter claimed.

The accompanying drawings, which are incorporated in and constitute part of this specification, are included to illustrate and provide a further understanding of the method and system of the disclosed subject matter. Together with the description, the drawings serve to explain the principles of the disclosed subject matter.

DETAILED DESCRIPTION OF AN EXEMPLARY EMBODIMENT

Figure 1:
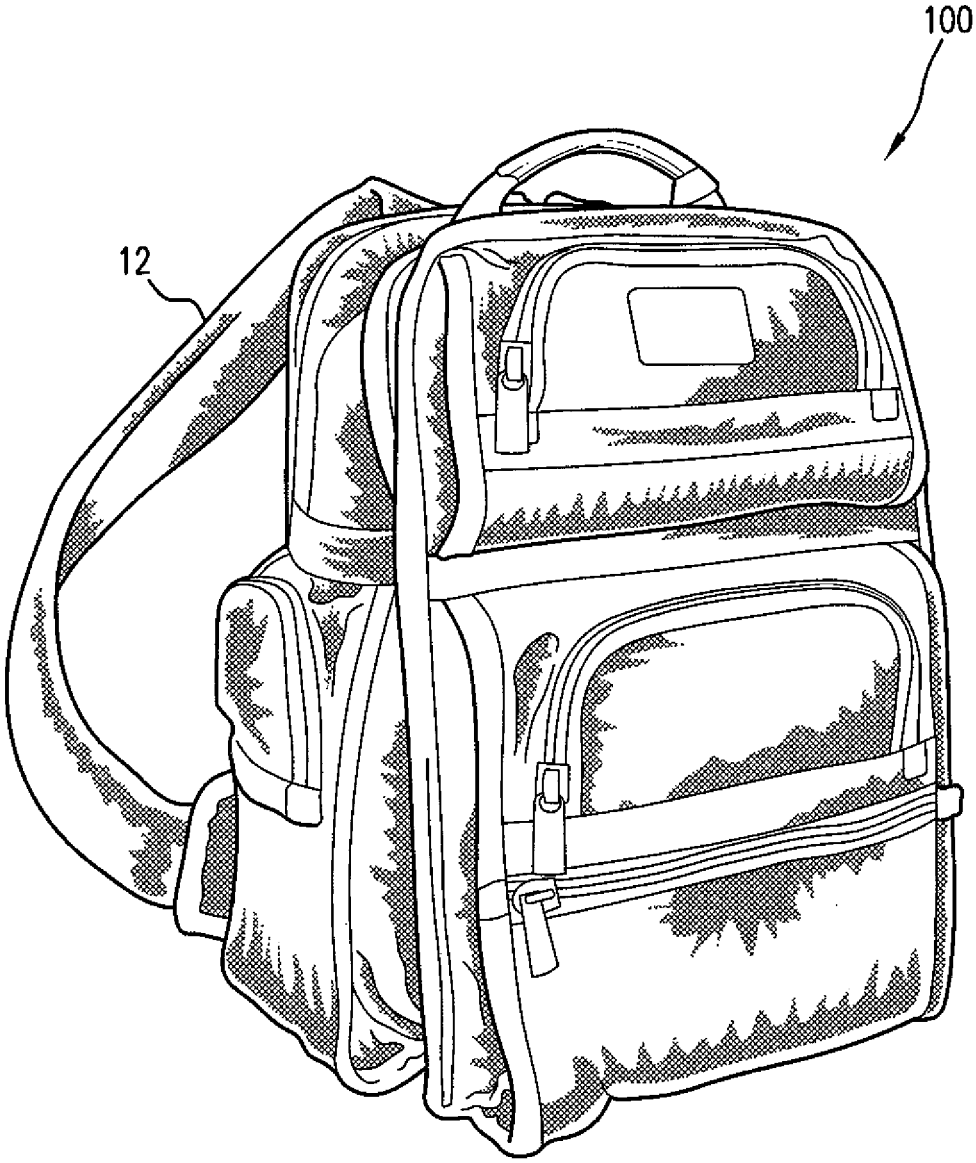
FIG. 1 is a schematic representation of an isometric view of a backpack in accordance with the disclosed subject matter.

Reference will now be made in detail to an exemplary embodiment of the disclosed subject matter, an illustration of which is provided in the accompanying drawings. The structure and corresponding method of the disclosed subject matter will be described in conjunction with the detailed description of the system.

The methods and structures presented herein may be used for a bag, such as backpacks, briefcases, suitcases, garment bags, golf bags, etc., having self-adjusting straps that can extend or elongate, and contract in response to a variety of cargo loads, user body sizes/shapes, as well as the range of movement by the user. The disclosed subject matter is particularly suited for bags having at least one shoulder strap comprising an elastic strip which is coupled to the bag at a single location, e.g., the bottom of the backpack panel. For purpose of explanation and illustration, and not limitation, an exemplary embodiment of the self-adjusting strap system in accordance with the disclosed subject matter is shown in FIGS. 1-5 and is designated generally by reference character 100.

Particularly, the disclosed subject matter is directed towards a bag having self-adjusting straps configured to be carried over a user's shoulder. According to an aspect of the disclosed subject matter, a shoulder strap can combine both elastic (i.e., stretchable) and inelastic (i.e., fixed length) members in such a way that the shoulder strap has a restricted ability to stretch and contract in a predetermined direction. The limited ability of the strap to stretch serves to minimize the bouncing action of the bag generated during user movement. Thus, the self-adjusting strap provides comfort for the user as well as a secure support structure which improves weight distribution across the user's shoulders, as discussed in further detail below.

The straps of the bag can comprise both an elastic strip and a webbing strip. The elastic strip can be made of any elastomeric material which provides suitable stretch characteristics to conform to various user body sizes/shapes and load capacities, as well as provide resistance to reduce the bouncing action of the load. The inelastic webbing strip, if present, defines the upper limit of displacement for the elastic strip and thereby serves as the primary load bearing portion of the strap when the elastic strip has reached its maximum length. Although the embodiment illustrated in the accompanying drawings depict a backpack, the self adjusting straps can be configured for use on a variety of bag sizes and shapes. Also, the elastic strips can be provided in a variety of lengths and/or orientations, e.g., vertical, diagonal, etc., thereby allowing for various amounts of displacement of the strap. The straps can further include additional features and/or materials such as foam padding, if so desired.

Figure 2:
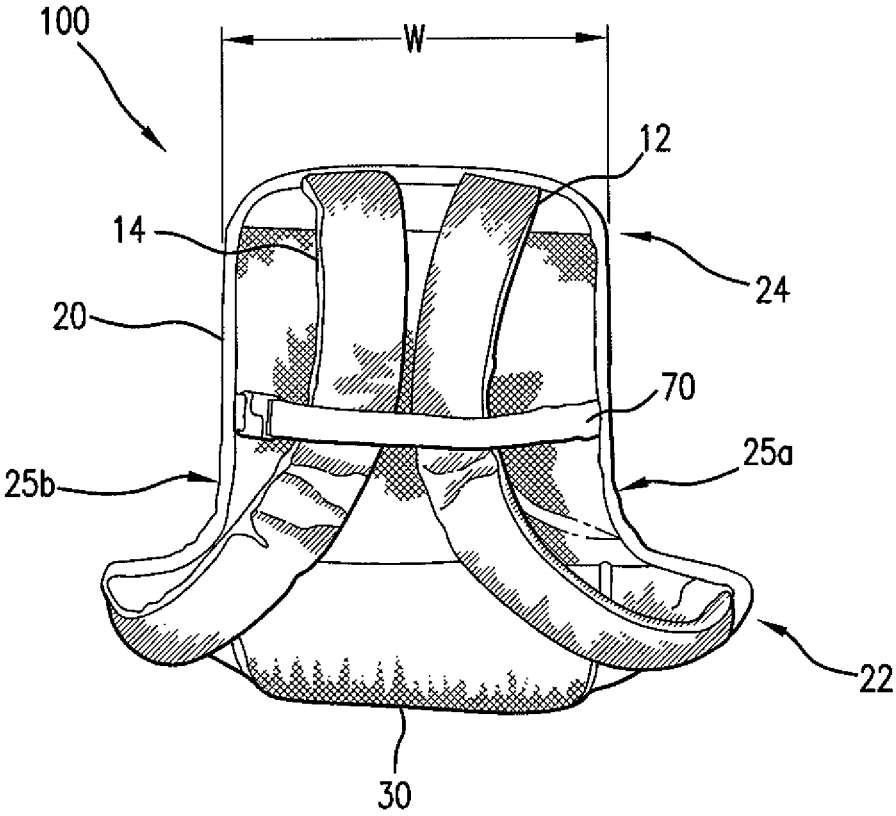
FIG. 2 is a rear view of an exterior surface of a bag with self-adjusting straps in accordance with the disclosed subject matter.

The exemplary embodiment illustrated in FIGS. 1-2 depict a backpack having a back panel 20 including a bottom portion 22 and a top portion 24, and two sides 25*a*, 25*b* defining a width "W" of the panel. In the embodiment of FIG. 2, two straps 12, 14 are coupled to the back panel 20. However, it is to be understood that alternative strap configurations are considered to be within the scope of the disclosed subject matter.

As embodied herein, the straps 12, 14 are coupled to the back panel 20 at a single position 30, e.g., along the bottom portion 22 at a midpoint between the two sides 25*a*, 25*b* of the panel 20.

In other words, the first end 12*a* of the strap 12 is coupled to an interior surface of the back panel 20 at a first attachment point, and the second end of the strap 12*b* is coupled to an exterior surface of the back panel 20 at a second attachment point, wherein the first and second attachment points are superimposed, or positioned over each other at a single location 30. For purpose of explanation and not limitation, the interior surface can refer to the surface of the panel facing the interior of the backpack, while the exterior surface can refer to the surface of the panel 22 opposite the interior surface and adjacent the user's back, when in use. Accordingly, the straps 12, 14 are not coupled to the bag at the upper portion 24 of the back panel.

The straps, which are arranged to be supported by the shoulders of a user, are adjustable such that orientation of a first shoulder of the user higher than the second shoulder produces a corresponding orientation of the first and second shoulder straps, thus maintaining a desired load distribution between the two shoulders independent of the relative orientation thereof. As such, each strap can extend or contract independent of the other strap. Additionally, the shoulder straps automatically reorient themselves so as to distribute the load evenly on both shoulders, thereby lessening user fatigue. Further, the top portion 12*c*, 14*c* of the straps which engage the user's shoulders, which are not attached to the panel 20 as discussed above, remain flat or flush against the user's shoulders throughout a range of movement by the user and/or a varied load capacity. This maximizes the surface area of the strap in contact with the shoulder to thereby provide a greater load distribution and maximize comfort.

Figure 3:
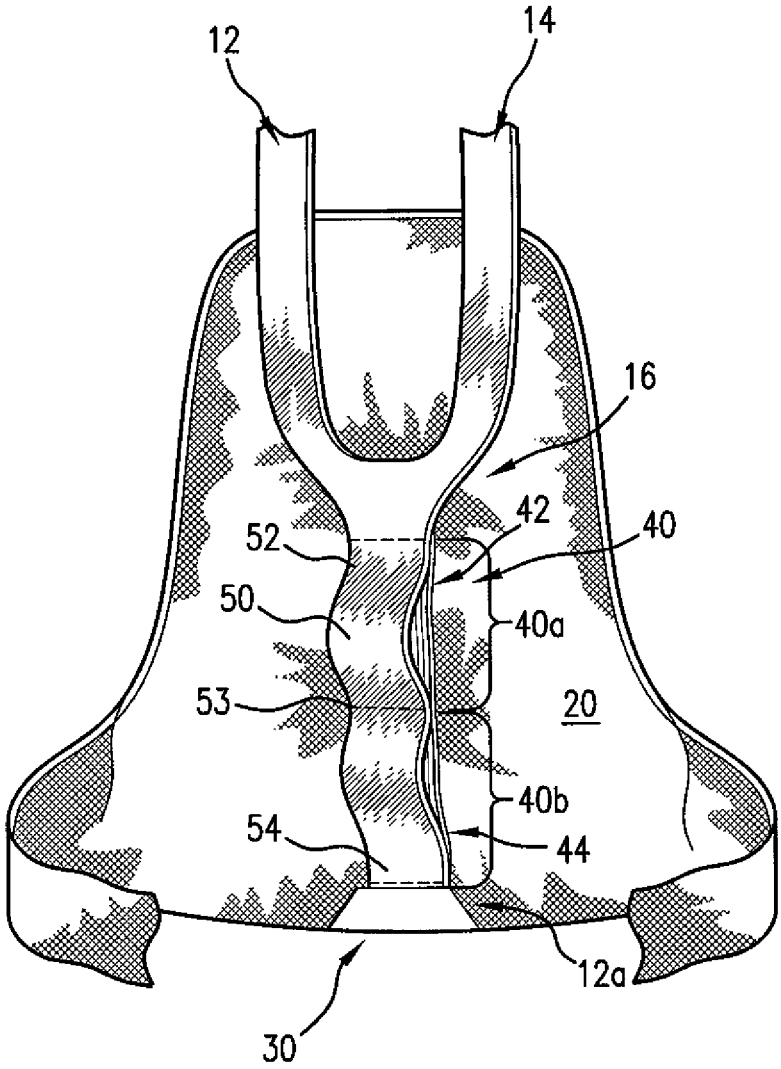
FIG. 3 is a schematic representation of an interior surface of a bag with self-adjusting straps depicting an elastic strip and a webbing strip in accordance with the disclosed subject matter.

The straps of the bag can be configured as two separate and discrete straps 12, 14. Additionally, or alternatively, the straps 12, 14 can be provided with a Y-shaped configuration on the interior portion of the bag, as illustrated in FIG. 3. In this embodiment, straps 12, 14 are joined or connected together at a union 16. As embodied herein, the straps are provided with an elastic strip 40 having a first end and a second end, wherein the distance between the first and second ends is variable depending on the amount of force, i.e. stretching, applied. As depicted in FIG. 3, the first end 42 of the elastic strip is coupled to the union 16, and the second end 44 of the elastic strip is coupled to the back panel 20 of the bag at attachment point 30, preferably at a midpoint along the bottom region 22 on an interior surface of the panel. As such, the elastic strip 40 provides elasticity or stretchability of straps 12, 14, primarily in a vertical direction, as shown in FIG. 3.

Further, an inelastic webbing strip 50 can be provided in a similar manner such that webbing strip 50 is coupled to the union 16 at a first end 52, and the second end 54 of the webbing strip is coupled to the back panel 20 of the bag at attachment point 30, preferably at a midpoint along the bottom region 22 on an interior surface of the panel. As noted above, the webbing strip 50 serves as a reinforcement to limit the amount of elasticity provided by the elastic strip 40. That is, once the elastic strip 40 has been stretched to a length that coincides with the length of the webbing strip 50, there can be no further extension of the elastic strip 40. This is advantageous as it provides improved strength characteristics and prevents overstretching and rupture of the elastic member 40, thereby allowing for the bag to be used in greater load capacities.

Additionally, the elastic strip 40 can be coupled to the webbing strip 50 to provide segmented or sequential elongation of the elastic strip 40. As illustrated in FIG. 3, the elastic strip 40 can be coupled to the webbing strip 50 at a midpoint 53 of the webbing strip 50. In this configuration, stretching of the elastic strip 40 will first occur in the upper half 40*a* of the strip, which results in the top portion of the strap adjusting prior to the bottom portion. This allows the straps to remain flush against the user's shoulders over a greater range of motion and/or load capacities.

Figure 4:
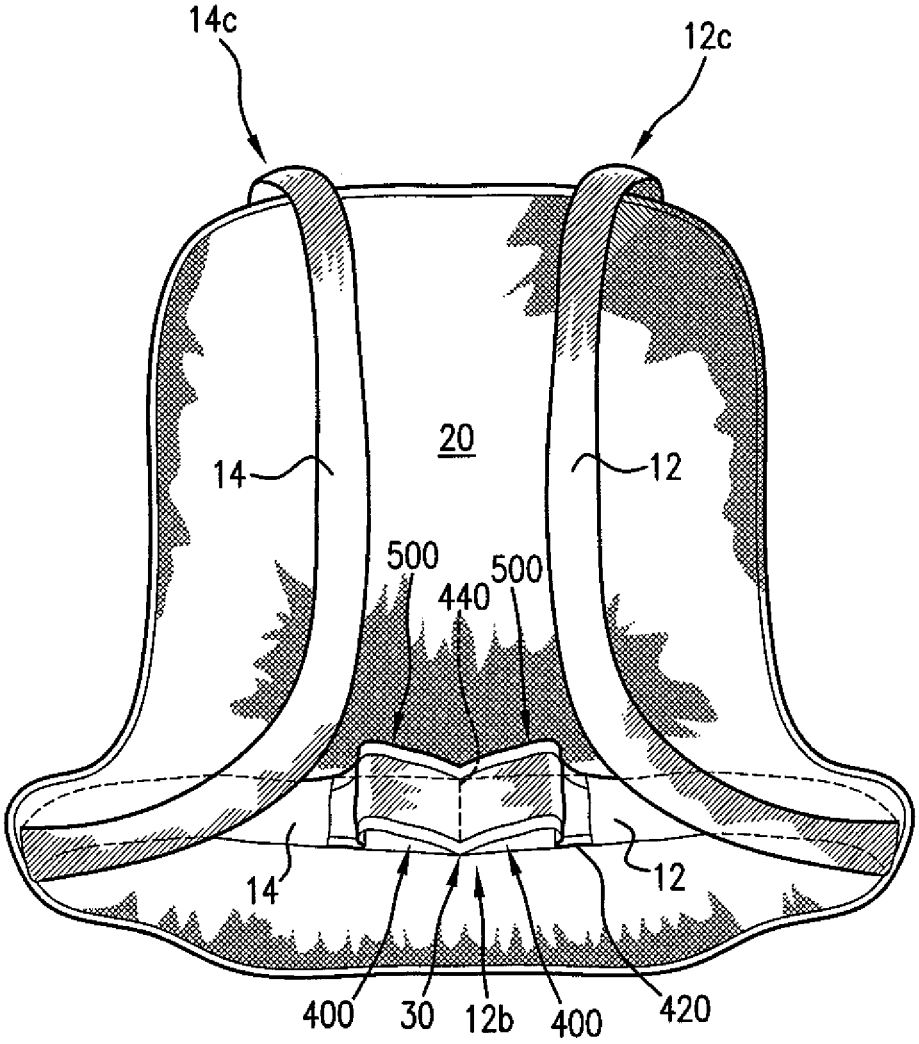
FIG. 4 is a schematic representation of a perspective view of an exterior surface of a bag with self-adjusting straps depicting an elastic strip and a webbing strip in accordance with the disclosed subject matter.
Figure 5:
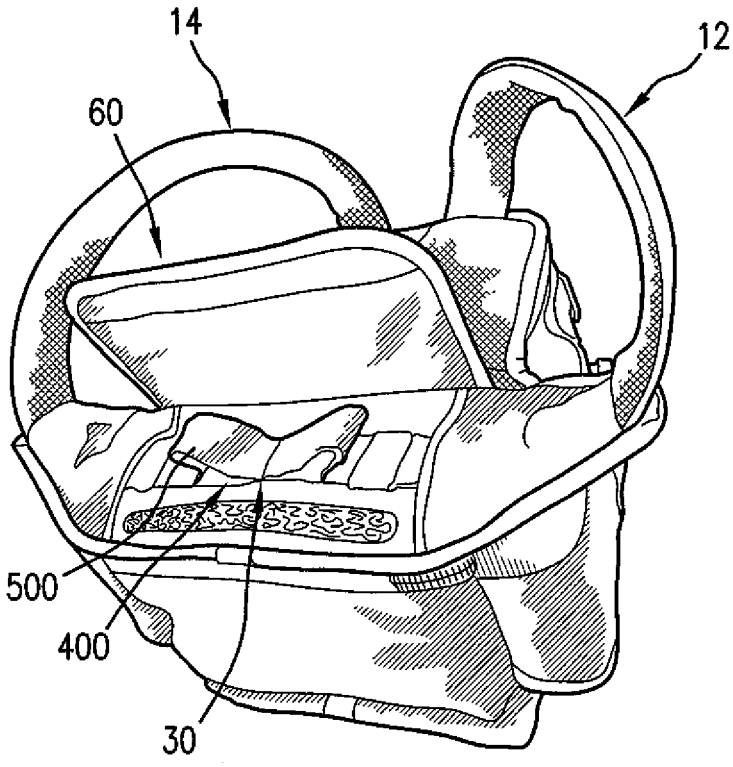
FIG. 5 is a schematic representation of a perspective view of a bottom of a bag with self-adjusting straps and a recloseable flap member in accordance with the disclosed subject matter.

Additionally, or alternatively, an elastic strip 400 can be provided along the lower portion of the back panel and oriented in a horizontal configuration, as shown in FIG. 4. Similarly, a webbing strip 500 can be provided, if so desired. As depicted in FIG. 4, the first end 420 of the elastic strip 400 is coupled to the strap 12, and the second end 440 of the elastic strip 400 is coupled to the back panel of the bag 20 at attachment point 30, preferably at a midpoint along the bottom region 22 on an exterior surface of the panel 20. As such, the elastic strip 400 provides elasticity or stretchability of straps 12, 14, primarily in a horizontal direction, as shown in FIG. 4. As depicted in the embodiment of FIGS. 4-5, the elastic strip 400 and webbing strip 500 can be coupled to the exterior surface of the back panel 20. Further, a closure or panel 60 can be provided with a releasable closure, e.g., hook and loop fasteners, to conceal the elastic strip 400 and webbing strip 500 during use to thereby prevent accidental snagging or damage thereto.

When a user is carrying a load, the vertical elastic strip 40 provides elasticity in a generally vertical direction to allow the load to adjust up or down on a user's back, and dampen any oscillation caused by the user. Similarly, the elastic horizontal strip 400 provides elasticity in a generally horizontal direction to allow the straps 12, 14 to adjust to the user's size, shape, and/or movement to maintain engagement of the bag with the user's body and provide lumbar support for the user's lower back and hips. Furthermore, this continuous engagement with the user's body serves to better distribute the weight of the load over a greater surface area of the user, thereby increasing the comfort and satisfaction. Further, the two elastic strips 40, 400 can be provided with a different coefficient of elasticity such that one strip is less elastic than the other. For example, the vertical elastic strip 40 can be made of a more elastic material such that the straps 12, 14 will displace a greater distance vertically than horizontally. This can further enhance the continuous engagement with the user's body for more efficient weight distribution.

In accordance with another aspect of the disclosed subject matter, the elastic strip 40, 400 which forms part of the self-adjusting straps allows the straps 12, 14 to be automatically retracted once the user removes the bag from the body, or reduces the load capacity. Further, there is no need for extraneous buckles, clasps, or slack in the strap itself, as is typical in conventional bag designs. This provides for a more compact bag design which is customized to each user and/or load capacity immediately upon placement on the user's body. Additionally, and as illustrated in FIG. 2, a strap retaining belt 70 can be incorporated into the back panel of the bag to secure the straps 12, 14 against the back panel 20. This is particularly useful for preventing accidental damage or snagging of the straps 12, 14, e.g., when storing the bag in an overhead compartment during transit.

Although the exemplary embodiment illustrated depicts the elastic strip 40 and webbing strip 50 disposed below the union 16 of straps 12, 14, additional elastic strips can be incorporated into the strap, if so desired. For example, an elastic strip can be provided at a location that engages the user's shoulder. Further, the construction of the strap can be modified to further ensure that the strap, and elastic strip 40 if present, lay flat against the user to better distribute the load. For example, the top portion of the straps 12*c*, 14*c* can have a reduced thickness (e.g., the foam padding can be reduced or eliminated) over the length of the straps 12, 14 that passes through the back panel 20, i.e., from the exterior of the bag to the interior.

It will be understood that the length of the elastic strip 40, 400 in a strap 12, 14 can be made either longer or shorter, as needed, in order to provide the particular amount of displacement or stretching action that is desired. Further, although the embodiments illustrated depict the webbing strip 50, 500 as a fixed length member, a webbing strip of an adjustable length is contemplated to be within the scope of the disclosed subject matter provided the webbing strip can serve as a reinforcement to limit the amount of elasticity provided by the elastic strip 3, as discussed above. The elastic strip and webbing strip can be coupled together to the shoulder strap and/or the bag panel by stitching, riveting or welding.

While the disclosed subject matter is described herein in terms of certain exemplary embodiments, those skilled in the art will recognize that various modifications and improvements may be made to the disclosed subject matter without departing from the scope thereof. Moreover, although individual features of one embodiment of the disclosed subject matter may be discussed herein or shown in the drawings of the one embodiment and not in other embodiments, it should be apparent that individual features of one embodiment may be combined with one or more features of another embodiment or features from a plurality of embodiments.

In addition to the specific embodiments claimed below, the disclosed subject matter is also directed to other embodiments having any other possible combination of the dependent features claimed below and those disclosed above. As such, the particular features presented in the dependent claims and disclosed above can be combined with each other in other manners within the scope of the disclosed subject matter such that the disclosed subject matter should be recognized as also specifically directed to other embodiments having any other possible combinations. Thus, the foregoing description of specific embodiments of the disclosed subject matter has been presented for purposes of illustration and description. It is not intended to be exhaustive or to limit the disclosed subject matter to those embodiments disclosed.

It will be apparent to those skilled in the art that various modifications and variations can be made in the method and system of the disclosed subject matter without departing from the spirit or scope of the disclosed subject matter. Thus, it is intended that the disclosed subject matter include modifications and variations that are within the scope of the appended claims and their equivalents.

The invention claimed is:

1. A bag configured to hold cargo, the bag comprising:

an exterior and an interior configured to receive cargo;

at least one panel having a top half, a bottom half, an interior surface, and an exterior surface;

at least one strap, each of the at least one strap having a first end and a second end and including:

an elastomeric strip having a first end and a second end, wherein the distance between the first end and second end is variable;

wherein the first and second ends of each of the at least one strap are coupled to a bottom half of the at least one panel, further wherein the first end of the at least one strap is coupled to the interior surface of the panel at a first connection location, the second end of the at least one strap is coupled to the exterior surface the panel at a second connection location, the first and second connection locations positioned directly over each other on opposing surfaces of the panel; and wherein the bag includes first and second sides defining a width of the bag having a midpoint therebetween, and wherein the first and second ends of the strap are coupled to the at least one panel at about the midpoint of the bag.

2. The bag of claim 1, wherein the at least one strap includes a webbing strip coupled to the elastomeric strip, the webbing strip having a substantially fixed length which limits the elongation of the elastomeric strip.

3. The bag of claim 2, wherein the elastic strip and the webbing strip are located about and coupled to the bottom half of the at least one panel.

4. The bag of claim 1, wherein the at least one strap comprises at least two separate straps.

5. The bag of claim 1, wherein the at least one strap is configured as a generally Y-shaped member.

6. The bag of claim 1, wherein the elastomeric strip is oriented substantially vertical with respect to the at least one panel, and a second elastomeric strip is oriented substantially perpendicular to the elastomeric strip.

7. The bag of claim 6, wherein the elastomeric strip is coupled to the interior surface of the panel, and the second elastomeric strip is readily accessible and is coupled to the exterior surface of the panel.

8. The bag of claim 6, wherein the bag is configured as a backpack.

9. A bag having self-adjusting straps comprising:

an exterior and an interior configured to receive cargo;

at least one panel having a top half, a bottom half, an interior surface, and an exterior surface;

at least one self-adjusting strap, each of the at least one self-adjusting strap having a first end and a second end including:

an elastomeric strip, the elastomeric strip having a first end and a second end, wherein the distance between the first end and second end is variable; and a webbing strip, the webbing strip having a substantially fixed length;

wherein the elastomeric strip and webbing strip are located about and coupled to the bottom half of at least one panel;

wherein the first end is coupled to the interior surface of the panel at a first connection location, the second end is coupled to the exterior surface of the panel at a second location, and the first and second connection locations are positioned directly over each other on opposing surfaces of the panel; and wherein the at least one strap is configured as a generally Y-shaped member.

10. The bag of claim 9, wherein the first and second ends of the strap are coupled to the bottom half of the at least one panel.

11. The bag of claim 9, wherein the elastomeric strip is oriented substantially vertical with respect to the at least one panel, and a second elastomeric strip is oriented substantially perpendicular to the elastomeric strip.

12. The bag of claim 11, wherein the elastomeric strip is coupled to the interior surface of the panel, and the second elastomeric strip is readily accessible and is coupled to the exterior surface of the panel.

13. The bag of claim 11, wherein the elastomeric strip is configured for greater displacement than the second elastomeric strip.

14. The bag of claim 9, wherein the at least one strap comprises at least two separate straps.

15. The bag of claim 9, wherein the elastomeric strip is stitched to the webbing strip.

16. The bag of claim 9, wherein the bag is configured as a backpack.

17. A bag having self-adjusting straps comprising:

an exterior and an interior configured to receive cargo;

at least one panel having a top half, a bottom half, an interior surface, and an exterior surface;

at least one self-adjusting strap, each of the at least one self-adjusting strap having a first end and a second end including:

an elastomeric strip, the elastomeric strip having a first end and a second end, wherein the distance between the first end and second end is variable; and a webbing strip, the webbing strip having a substantially fixed length;

wherein the elastomeric strip and webbing strip are located about and coupled to the bottom half of at least one panel;

wherein the first end is coupled to the interior surface of the panel at a first connection location, the second end is coupled to the exterior surface of the panel at a second location, and the first and second connection locations are positioned directly over each other on opposing surfaces of the panel; and wherein the at least one strap is configured as a generally Y-shaped member.

* * * * *